US010851494B2

(12) United States Patent
Hata et al.

(10) Patent No.: US 10,851,494 B2
(45) Date of Patent: Dec. 1, 2020

(54) METHOD FOR PREPARING BLACK LIQUOR AND METHOD FOR PREPARING FLAVOR COMPONENT-CONTAINING LIQUID

(71) Applicant: JAPAN TOBACCO INC., Tokyo (JP)

(72) Inventors: Shigeru Hata, Tokyo (JP); Yoshito Gohara, Tokyo (JP); Ryosuke Nagase, Tokyo (JP); Takuya Okada, Tokyo (JP); Shintaro Akiyama, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 1244 days.

(21) Appl. No.: 14/750,592

(22) Filed: Jun. 25, 2015

(65) Prior Publication Data

US 2015/0292152 A1 Oct. 15, 2015

Related U.S. Application Data

(63) Continuation of application No. PCT/JP2014/057811, filed on Mar. 20, 2014.

(30) Foreign Application Priority Data

Mar. 21, 2013 (JP) ..... 2013-059045

(51) Int. Cl.
*A24B 15/28* (2006.01)
*A24B 15/18* (2006.01)
(Continued)

(52) U.S. Cl.
CPC ..... *D21C 11/0057* (2013.01); *A24B 13/00* (2013.01); *A24B 15/18* (2013.01);
(Continued)

(58) Field of Classification Search
None
See application file for complete search history.

(56) References Cited

U.S. PATENT DOCUMENTS 2,516,827 A 7/1950 Marshall et al.
2,576,752 A 11/1951 Fisher et al.
(Continued)

FOREIGN PATENT DOCUMENTS

CN 1201778 A 12/1998
CN 1322498 A 11/2001
(Continued)

OTHER PUBLICATIONS

Agrupis et al. "Industrial utilization of tobacco stalks II: preparation and characterization of tobacco pulp by steam explosion pulping", Journal of Wood Science, 2000, 46:222-229.*
(Continued)

*Primary Examiner* — Michael H. Wilson
*Assistant Examiner* — Katherine Will
(74) *Attorney, Agent, or Firm* — Birch, Stewart, Kolasch & Birch, LLP

(57) ABSTRACT

A method for preparing a black liquor according to the present invention comprises digesting a tobacco raw material under an alkaline condition to obtain the black liquor. Further, a method for preparing a flavor component-containing liquid according to the present invention comprises digesting a tobacco raw material under an alkaline condition, separating the obtained digesting product into a black liquor and a tobacco fiber, and desalinating the black liquor to obtain the flavor component-containing liquid.

10 Claims, 7 Drawing Sheets

(51) Int. Cl.

| | |
|---|---|
| ***D21C 11/00*** | (2006.01) |
| ***A24B 13/00*** | (2006.01) |
| ***A24B 15/30*** | (2006.01) |
| ***D21C 3/02*** | (2006.01) |
| ***A24B 15/24*** | (2006.01) |

(52) U.S. Cl.

CPC ..... *A24B 15/24* (2013.01); *A24B 15/28* (2013.01); *A24B 15/305* (2013.01); *D21C 3/02* (2013.01); *D21C 11/0007* (2013.01)

(56) References Cited

U.S. PATENT DOCUMENTS

| | | | | |
|---|---|---|---|---|
| 2,576,753 | A | 11/1951 | Fisher et al. | |
| 2,686,120 | A * | 8/1954 | Marshall | C07C 45/32 162/14 |
| 3,860,012 | A | 1/1975 | Selke | |
| 4,002,526 | A * | 1/1977 | Brown | D21C 9/1036 162/57 |
| 4,182,349 | A | 1/1980 | Selke | |
| 4,250,088 | A * | 2/1981 | Yang | C08H 6/00 530/505 |
| 5,489,363 | A | 2/1996 | Marcoccia et al. | |
| 5,547,542 | A * | 8/1996 | Landfors | B01D 61/44 162/29 |
| 6,100,385 | A * | 8/2000 | Naae | C07G 1/00 530/502 |
| 8,808,781 | B2 * | 8/2014 | Stecker | C25B 3/02 205/338 |
| 2002/0129910 | A1 * | 9/2002 | Lightner | C08H 6/00 162/16 |
| 2005/0241657 | A1 | 11/2005 | Mua et al. | |
| 2006/0130859 | A1 | 6/2006 | Mua et al. | |
| 2010/0180903 | A1 * | 7/2010 | Cooper | A24D 1/025 131/58 |
| 2013/0014771 | A1 * | 1/2013 | Coleman, III | A24B 15/20 131/298 |

FOREIGN PATENT DOCUMENTS

| | | | |
|---|---|---|---|
| CN | 102127878 | A | 7/2011 |
| CN | 102733219 | A | 10/2012 |
| JP | 3-000812 | B1 | 3/1928 |
| JP | 44-002045 | B1 | 1/1969 |
| JP | 2010-201740 | A | 9/2010 |
| JP | 2011-184643 | A | 9/2011 |
| JP | 2012-000002 | A | 1/2012 |
| RU | 2127783 | C1 | 3/1999 |
| RU | 2348749 | C2 | 3/2009 |
| WO | WO 2005/045126 | A1 | 5/2005 |
| WO | WO 2010/080489 | A1 | 7/2010 |

OTHER PUBLICATIONS

Russian Office Action and Search Report, dated Feb. 16, 2017, for Russian Application No. 2015130592/12, with an English translation of the Office Action.

Chinese Office Action and Search Report, dated Feb. 4, 2017, for Chinese Application No. 201480005962.4, along with an English translation.

First Office Action dated Feb. 2, 2016, in Japanese Patent Application No. 2015-506855, with English translation.

Chinese Office Action Repor and Chinese Search Report, dated May 26, 2016, for Chinese Application No. 201480005962.4, along with English translations.

English translation of International Preliminary Report on Patentability dated Sep. 24, 2015, in PCT International Application No. PCT/JP2014/057811.

Extended European Search Report dated Oct. 25, 2016, in European Patent Application No. 14768356.9.

Chinese Office Action and English translation, dated Aug. 3, 2017, for Chinese Application No. 201480005962.4.

English translation of the Written Opinion of the International Searching Authority (Form PCT/ISA/237) for International Application No. PCT/JP2014/057811, dated Jun. 24, 2014.

Partial English translation of JP-44-002045-B1, published Jan. 29, 1969.

International Preliminary Report on Patentability issued in PCT/JP2014/057811, dated Oct. 7, 2014.

International Search Report issued in PCT/JP2014/057811, dated Jun. 24, 2014.

Office Action issued in Japanese Patent Application No. 2015-506855, dated Jun. 2, 2015.

Written Opinion issued in PCT/JP2014/057811, dated Jun. 24, 2014.

* cited by examiner

METHOD FOR PREPARING BLACK LIQUOR AND METHOD FOR PREPARING FLAVOR COMPONENT-CONTAINING LIQUID

CROSS REFERENCE TO RELATED APPLICATIONS

This application is a Continuation Application of PCT Application No. PCT/JP2014/057811, filed Mar. 20, 2014 and based upon and claiming the benefit of priority from Japanese Patent Application No. 2013-059045, filed Mar. 21, 2013, the entire contents of all of which are incorporated herein by reference.

TECHNICAL FIELD

The present invention relates to a method for preparing a black liquor obtained by treating a tobacco raw material. The present invention also relates to a method for preparing a flavor component-containing liquid obtained by treating the black liquor.

BACKGROUND ART

A black liquor generally refers to a black or brown liquid obtained by a digesting treatment in a pulp production process. Herein, the digesting treatment is a treatment for obtaining pulp by heating a pulp raw material with a chemical solution. The obtained pulp is industrially utilized as a raw material for paper, a sheet or the like.

The digesting treatment is performed by various methods. Examples of the methods include a kraft pulping process using a mixed solution of sodium hydroxide and sodium sulfate; a soda pulping process using an aqueous sodium hydroxide solution; an acid sulfite pulping process using bisulfite and sulfite gas; and a neutral sulfite pulping process using sodium hydroxide and bisulfite. The digesting treatment is generally performed under severe conditions, which makes it difficult to control the reaction. Therefore, the digesting treatment is not performed in order to obtain an intended specific compound. When wood pulp is industrially obtained, the black liquor obtained by the digesting treatment is often disposed of in the present circumstances.

On the other hand, in the tobacco industry, a sheet tobacco produced using a tobacco fiber as a raw material has been known. For example, the sheet tobacco is obtained by stirring a short midrib or a fine powder of a tobacco raw material in warm water of about 60° C., thereafter separating the resultant product into an extracted liquid and a residue (that is, a tobacco fiber), and making a sheet from the obtained tobacco fiber. A technique of appropriately adding a flavor preferable for a tobacco to the sheet tobacco has been known. As such a technique, for example, a flavor component-containing extract obtained at the time of extracting a tobacco fiber from a tobacco raw material is generally added to the sheet tobacco.

Examples of flavor components preferable for a tobacco include vanillin. A method of oxidizing a black liquor which is obtained at the time of producing sulfite pulp, under an alkaline condition has been known as a method for preparing vanillin (Patent Documents 1 to 3).

PRIOR ART DOCUMENT

Patent Document

Patent Document 1: U.S. Pat. No. 2,516,827
Patent Document 2: U.S. Pat. No. 2,576,752

Patent Document 3: U.S. Pat. No. 2,576,753

SUMMARY OF INVENTION

Technical Problem

If the method for preparing vanillin is applied to a tobacco raw material containing lignin, a black liquor containing vanillin is expected to be obtained. Further, if the black liquor thus obtained is added to a tobacco fiber, a sheet tobacco having a good flavor is expected to be obtained. On the other hand, the method for preparing vanillin using the acid sulfite pulping process, in which sulfur dioxide is used as a chemical agent, is known. Similarly, a method using a neutral sulfite pulping process, in which sodium sulfide is used as a chemical agent, is also known. However, if the tobacco raw material or the tobacco extracted liquid are treated with a compound containing sulfur, the treatment may impair the smoking taste of the tobacco, which is not preferable. Additionally, since the acid sulfite pulping process is a multistage operation that involves performing heating two or more times, the acid sulfite pulping process is problematic as regards the complexity of the treatment equipment required.

Therefore, an object of the present invention is to provide a method for preparing a black liquor by which a flavor component-containing black liquor can be obtained with fewer treating processes without impairing the smoking taste of a tobacco. Another object of the present invention is to provide a method for preparing a flavor component-containing liquid obtained by treating the black liquor.

Solution to Problem

According to a first aspect according to the present invention, there is provided a method for preparing a black liquor, the method comprising digesting a tobacco raw material under an alkaline condition to obtain the black liquor.

According to a second aspect according to the present invention, there is provided a method for preparing a flavor component-containing liquid, the method comprising: digesting a tobacco raw material under an alkaline condition; separating a product obtained by the digesting into a black liquor and a tobacco fiber; and desalinating the black liquor to obtain the flavor component-containing liquid.

Advantageous Effects of Invention

The present invention can provide a method for preparing a black liquor by which a flavor component-containing black liquor can be obtained with fewer treating processes. The present invention can also provide a method for preparing a flavor component-containing liquid obtained by treating the black liquor.

DESCRIPTION OF EMBODIMENTS

Hereinafter, an embodiment of the present invention will be described in detail.

First, a method for preparing a black liquor according to an aspect of the present invention will be described with reference to FIG. 1.

Figure 1:
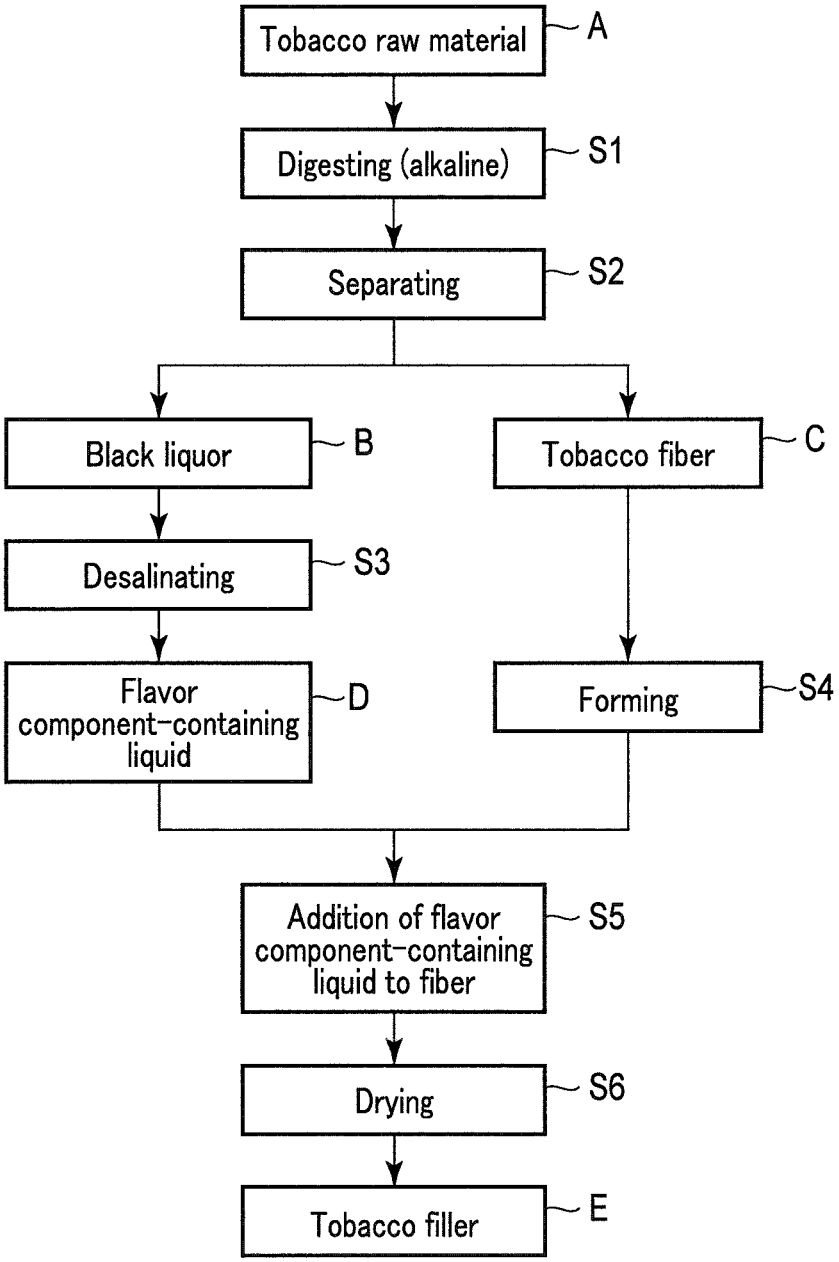
FIG. 1 is a flow chart showing a method for preparing a black liquor, a flavor component-containing liquid, and a tobacco filler according to the present invention.

FIG. 1 is a flow chart showing a method for preparing a black liquor, a flavor component-containing liquid, and a tobacco filler according to the present invention. The method for preparing a black liquor according to the present invention includes digesting a tobacco raw material under an alkaline condition to obtain the black liquor. Specifically, a tobacco raw material (A) is subjected to a digesting treatment under an alkaline condition (S1), and a the resultant product is separated (S2) to obtain a black liquor (B) and a tobacco fiber (C). According to this method, a black liquor containing a flavor component can be obtained with fewer treating processes.

A tobacco raw material derived from a plant of the genus *Nicotiana* can be appropriately used as the tobacco raw material (A). A tobacco raw material containing a large amount of tobacco midrib, stalk, and root is preferably used. This is because the tobacco midrib, stalk, and root contain a larger amount of lignin as a raw material of vanillin than that contained in tobacco leaf (a leaf portion excluding the tobacco midrib).

The digesting treatment (S1) is performed by heating the tobacco raw material (A) in a chemical solution. In the present invention, the digesting treatment (S1) is performed under an alkaline condition. As long as the condition is alkaline, the extent of alkalinity is not limited. The digesting treatment (S1) is preferably performed under a strong alkaline condition. For example, the alkaline condition is made by using an alkaline solution as a chemical solution for the digesting treatment. The concentration of the chemical solution can be appropriately adjusted so that the chemical solution has a pH suitable for the digesting treatment. In the case of using the alkaline solution, the solution can be used in a concentration of, for example, 0.01 normality or more, and preferably 0.1 normality or more (hereinafter, 'normality' is also expressed as N). Although the upper limit of the concentration is not particularly limited, the alkaline solution can be used in a concentration of, for example, 0.1 to 2 normality.

In order to make the alkaline condition suitable for the digesting treatment, an alkaline solution having preferably a pH of 12 or more, and more preferably a pH of 13 or more, is used. Although the upper limit of the pH is not particularly limited, an alkaline solution having, for example, a pH of 12 to 14.3, and preferably a pH of 13 to 14.3, can be used. Examples of the alkaline solution to be preferably used include an NaOH aqueous solution, a KOH aqueous solution, a $K_2CO_3$ aqueous solution, an $Na_2CO_3$ aqueous solution, and an $NaHCO_3$ aqueous solution. The chemical solution is particularly preferably a strong base aqueous solution of 0.1 normality or more. A vanillin production amount tends to be increased when the pH of the chemical solution is increased.

The used amount of the chemical solution varies depending on the pH of the chemical solution to be used. The used amount is not particularly limited as long as the tobacco raw material is sufficiently digested. For example, a ratio of the mass (g) of the tobacco raw material to the used amount (mL) of the chemical solution is preferably 1:2 to 1:100, more preferably 1:3 to 1:100, still more preferably 1:3 to 1:50, yet still more preferably 1:5 to 1:50, and particularly preferably 1:10 to 1:50.

Figure 5:
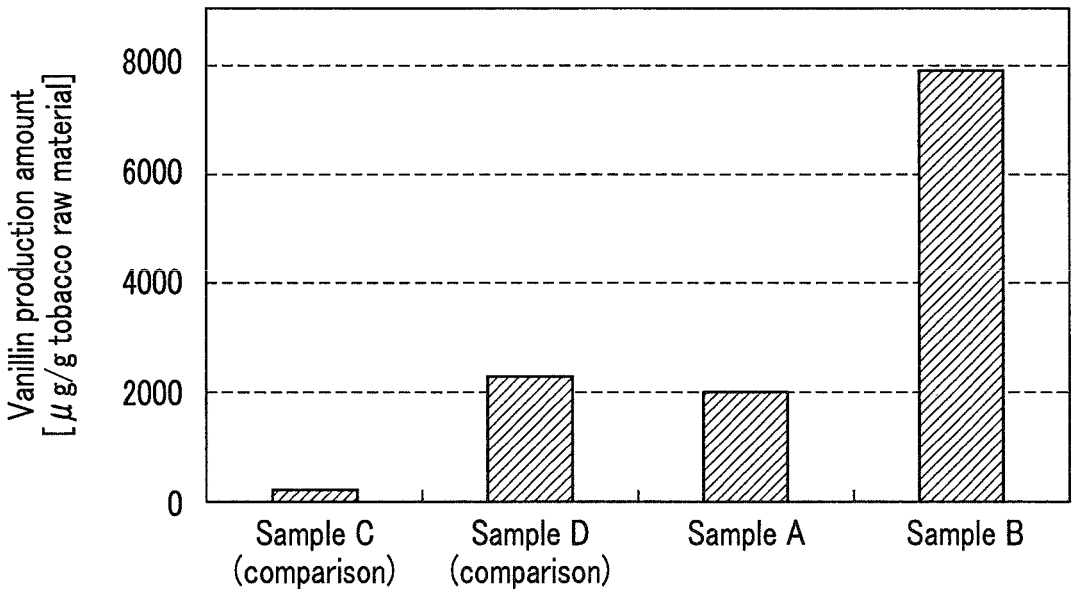
FIG. 5 shows the results of Example 5.
Figure 6:
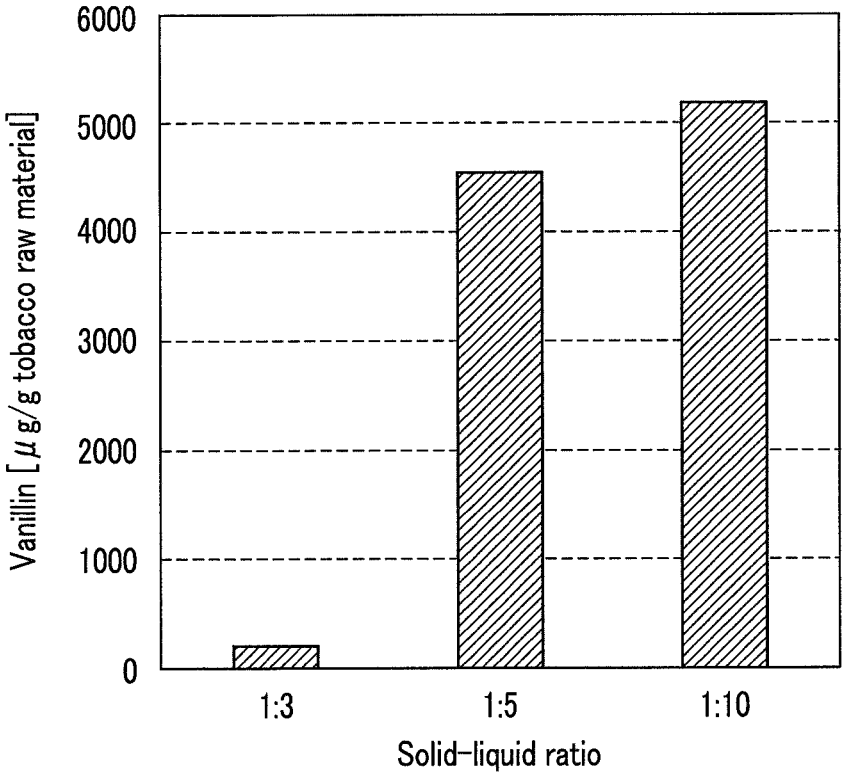
FIG. 6 shows the relationship of a vanillin production amount to a solid-liquid ratio in a digesting treatment in an oxygen atmosphere.

From the results of FIG. 6, when the lower limit of a liquid amount of the solid-liquid ratio is within a range of 3 or more and less than 5, a large significant difference occurs in the vanillin production amount. On the other hand, concerning the results of FIG. 6 for the upper limit of the liquid amount of the solid-liquid ratio, the solid-liquid ratios of 1:5 and 1:10 both provide a good vanillin production amount. Furthermore, even the solid-liquid ratio of 1:50 provides a good vanillin production amount under a slightly different experimental condition in a sample B of FIG. 5. In view of these facts, when the solid-liquid ratio is as described above, it is considered that the amount of the flavor component in the obtained black liquor tends to be increased as the amount of the chemical solution to be used is increased. In light of a commonsensical implementing environment when the present invention is implemented, it is considered that the upper limit of the liquid amount of the solid-liquid ratio is generally about 100. However, since it is considered that the amount of the flavor component in the black liquor is increased as the amount of the chemical solution to be used is increased as described above, the upper limit is not uniformly determined.

In general, a digesting treatment is performed at 120 to 180° C. Also in the present invention, the digesting treatment can be performed at the above temperature, more preferably 130 to 180° C., and particularly preferably 150 to 180° C. The amount of the flavor component in the black liquor tends to be increased as the temperature of the digesting treatment is increased within the above range. The reaction time of the digesting treatment is not particularly limited as long as the tobacco raw material is sufficiently digested in the reaction time. The reaction time varies depending on the pH of the chemical solution to be used. For example, the reaction time is preferably about 5 minutes to 6 hours, more preferably 30 minutes to 6 hours, and particularly preferably 1 hour to 6 hours. When the reaction time is set to 1 hour or more, the vanillin production amount tends to be stably increased. The vanillin production amount tends to be increased when the digesting treatment is performed for a longer period of time within the above range.

The digesting treatment is preferably performed in an oxygen atmosphere. A black liquor having a larger amount of flavor component can be obtained in a shorter time by performing the digesting treatment in the oxygen atmosphere. Specifically, air in a container containing the tobacco raw material and the chemical solution for the digesting treatment is replaced with oxygen to fill the container with oxygen, and the container is heated. The container is filled with oxygen so that the gage pressure in the container is preferably 0.05 to 1.0 MPa, more preferably 0.1 to 0.7 MPa, and particularly preferably 0.1 to 0.4 MPa.

Examples of a method for making a high oxygen atmosphere state include, but are not limited to, a method of injecting only oxygen into a container under pressure, and a method of injecting air into a container under pressure. When the air is injected under pressure, the air is injected under pressure so that the gage pressure in the container is preferably 0.25 to 5 MPa, more preferably 0.5 to 3.5 MPa, and particularly preferably 0.5 to 2.0 MPa.

A treatment after filling the container with oxygen can be performed in the same way as the above case where the oxygen filling is not performed.

After the digesting treatment, a step (S2) of separating the digesting product into the black liquor (B) and the tobacco fiber (C) can be performed by appropriately selecting a known separating method. Examples of the method include a screw press, a screen, and centrifugal dehydration.

Next, a method for preparing a flavor component-containing liquid according to another embodiment of the present invention will be described with reference to FIG. 1.

The method for preparing a flavor component-containing liquid according to the present invention includes the following steps:

(i) digesting (S1) a tobacco raw material (A) under an alkaline condition;

(ii) separating (S2) a product obtained by the digesting into a black liquor (B) and a tobacco fiber (C);

and (iii) desalinating (S3) the black liquor (B) to obtain a flavor component-containing liquid (D).

After the digesting step under the alkaline condition (S1) or the subsequent separating step (S2), the digesting product (that is, the product after the digesting step and before the separating step) or the black liquor (B) may be optionally neutralized.

Herein, the desalinating means a step of removing a salt from the black liquor to separate the flavor component produced by the alkaline digesting and the salt from each other. Thereby, a flavor component-containing liquid containing no salt can be obtained.

Hereinafter, each of the above steps will be described in detail.

The steps of (i) and (ii) are as described above.

In the desalinating step (S3) of (iii), inorganic ions such as $Na^+$ contained in the black liquor (B) or salts such as NaCl generated by neutralizing the black liquor (B) are removed to obtain a flavor component-containing liquid (D). Particularly, when a tobacco raw material is digested under a strong alkaline condition, the obtained black liquor (B) contains a large amount of inorganic ions ($Na^+$ or the like) or salts (NaCl or the like). However, the inorganic ions or the salts adversely affect the smoking taste of a cigarette. Therefore, if the inorganic ions or the salts are removed from the black liquor to obtain the flavor component-containing liquid (D) of the present invention, and a tobacco filler produced by using the flavor component-containing liquid is applied to a cigarette, a flavor can be efficiently exhibited.

Examples of the desalinating step (S3) include a method using solvent extraction. Non-polar solvents such as ethyl acetate, hexane, and diethylether can be used as a solvent. In the method using the solvent extraction, first, a black liquor is neutralized. Herein, the neutralizing step is performed by adding an acid to the black liquor (B). Any acid can be used herein, as long as it can neutralize the black liquor (B). Examples of the acid include hydrochloric acid, sulfuric acid, and nitric acid. The pH of the black liquor (B) after the neutralizing step is preferably 7 or less, and more preferably 2.0 to 6.0. If the black liquor is neutralized, the black liquor can be efficiently desalinated by the solvent extraction.

Another example of the desalinating method includes a method using ion exchange. In this method, the black liquor (B) is desalinated by exchanging the inorganic ions in the black liquor (B) with hydrogen ions using a cation-exchange resin or the like. The pH of the flavor component-containing liquid (D) obtained by desalinating the black liquor (B) by the ion exchange is usually 7 or less.

Furthermore, the desalinating step (S3) can be performed by methods such as vacuum concentration and steam distillation. However, the method is not limited thereto.

As another desalinating method, a flavor component can be efficiently obtained by bringing a black liquor into contact with a synthetic adsorbent to make an intended flavor component contained in the black liquor adsorb to the synthetic adsorbent, removing the black liquor containing inorganic ions or salts, and making the flavor component desorb from the synthetic adsorbent using a suitable chemical agent. Herein, the synthetic adsorbent refers to a spherical cross-linked polymer prepared so as to have a porous structure by a special synthetic technique. Specifically, it refers to a product which is commercially available under the name of "synthetic adsorbent". Since the synthetic adsorbent has no functional group, unlike an ion-exchange resin, the synthetic adsorbent has an advantage that it is chemically stable. Examples of the synthetic adsorbent used herein include a styrene-based synthetic adsorbent, an acrylic synthetic adsorbent, and a phenol-based synthetic adsorbent. Specific examples include, but are not limited to, Amberlite XAD (Organo Corporation) and Sepabeads (Mitsubishi Chemical Corporation).

The flavor component-containing liquid (D) obtained as described above contains a flavor component capable of improving the flavor of the cigarette. Examples of the flavor component include, but are not limited to, vanillin, syringaldehyde (also referred to as 4-hydroxy-3,5-dimethoxydibenzaldehyde), acetovanillone (also referred to as 4'-hydroxyl-3'-methoxyacetophenone), and acetosyringone (also referred to as 4'-hydroxy-3',5'-dimethoxyacetophenone).

As described above, the flavor component-containing liquid (D) of the present invention is obtained through the desalinating step (S3). Therefore, even if the tobacco filler produced by using the flavor component-containing liquid of the present invention is applied to a cigarette, the tobacco filler does not adversely affect the smoking taste of the cigarette.

Next, a method for preparing a tobacco filler according to another embodiment of the present invention will be described with reference to FIG. 1.

A method for preparing a tobacco filler according to the present invention includes applying the flavor component-containing liquid obtained as described above to a plant fiber or a formed product of the plant fiber. Examples of the plant fiber include a tobacco fiber. Furthermore, the plant fiber may be a fiber obtained from a plant other than a tobacco. The plant fiber may be obtained by mixing these fibers. Any plant fiber can be used without particular limitation as long as the plant fiber can be used to produce a tobacco filler. Hereinafter, a case where the tobacco fiber is used as the plant fiber will be described.

Specifically, addition (S5) of a flavor component-containing liquid (D) to a tobacco fiber (C) obtained by the digesting (S1) of a tobacco raw material (A) and the separating (S2) is performed. The tobacco fiber used herein may be a tobacco fiber (C) obtained from the same raw material in a process of preparing the flavor component-containing liquid (D) as described above, or may be a tobacco fiber obtained by another process.

The amount of the flavor component-containing liquid (D) added to the tobacco fiber can be appropriately set within a range where a desired flavor is obtained when the obtained tobacco filler is used for a cigarette.

The flavor component-containing liquid (D) may be concentrated to a predetermined concentration (for example, 5 to 10 times) via a concentration machine or the like, and then the concentrated flavor component-containing liquid (D) may be added to the tobacco fiber (C). When the concentrated liquid is used, the added amount of the concentrated liquid is preferably adjusted so that the amount of a flavor component contained in the tobacco fiber at the time of adding the concentrated liquid is the same as the amount of a flavor component contained in the tobacco fiber at the time of adding a non-concentrated flavor component-containing liquid in the above preferable amount.

The flavor component-containing liquid (D) can be added to the tobacco fiber (C) or the formed product of the tobacco fiber by a means appropriately selected from known addition methods. For example, the flavor component-containing liquid (D) can be added by means such as spraying, immersing, and coating.

After the flavor component-containing liquid (D) is added, a drying treatment (S6) is performed in a drier, and thereby a tobacco filler (E) according to the present invention adjusted to a predetermined moisture content is produced. A moisture content in the dried tobacco filler (E) is, for example, 5 to 15% by weight, and preferably 11 to 13% by weight.

The tobacco fiber (C) may be optionally formed into a predetermined shape (S4) before the flavor component-containing liquid (D) is added. When the tobacco fiber (C) is formed, the shape of the tobacco fiber is appropriately determined according to the intended shape of the tobacco filler. For example, a sheet tobacco can be produced by using the tobacco fiber (C) or the formed product of the tobacco fiber (C) as a base sheet tobacco. The shape of the tobacco fiber (C) may be, for example, a powdery shape or a shape molded by extrusion molding.

The sheet tobacco is produced by forming the tobacco fiber (C) into a sheet shape to produce a base sheet tobacco, and adding the flavor component-containing liquid (D) to the base sheet tobacco. The base sheet tobacco is produced by mixing a tobacco fiber obtained from a tobacco raw material with optionally a reinforcing agent and a binding agent in the presence of water or the like to form the tobacco fiber into a sheet shape, and drying the sheet. A moisturizing agent, a flavor, and a water resistant agent or the like in addition to the above flavor component-containing liquid can be appropriately added to the base sheet tobacco.

A fiberized product of pulp, or the like can be preferably used as the reinforcing agent. A carboxymethylcellulose sodium salt, methyl cellulose, ethyl cellulose, starch, sodium alginate, locust bean gum, and gum arabic or the like can be used as the binding agent.

However, the binding agent is not limited thereto.

Polyhydric alcohols such as glycerin and propylene glycol; a mixture of a polyhydric alcohol and corn syrup; and sugar alcohols such as sorbitol and maltitol; or the like can be used as the moisturizing agent. Furthermore, sugars and fruit extracts or the like can be used as the flavor.

For example, the base sheet tobacco can be produced by using a sheet tobacco producing apparatus disclosed in Jpn. Pat. Appln. KOKAI Publication No. 3-224472. The flavor component-containing liquid can be added to the base sheet tobacco by spray flavoring (electrostatic coating), roll coating, gravure coating, and a size press or the like. The addition rate of the flavor component to the sheet tobacco is about 30% when using the spray flavoring (electrostatic coating), and by contrast, is about 90% when using the roll coating or the gravure coating. Therefore, when using the roll coating or the gravure coating, the flavor and taste of the sheet tobacco can be enhanced by effectively using a small amount of the flavor component-containing liquid.

The obtained sheet tobacco is appropriately cut and used as a tobacco filler.

The present invention relates also to a tobacco filler obtained by the above method, and a tobacco product containing the tobacco filler. If the tobacco filler obtained by the above method is applied to a cigarette, a cigarette having excellent flavor and taste can be obtained. The obtained sheet tobacco can be used also as a material for cigarette manufacturing (for example, cigarette paper, a filter, wrapping paper, and a package). Furthermore, the obtained sheet tobacco can be used for tobacco products other than the cigarette, for example, tobacco products such as a pipe, a cigar, a cigarillo; noncombustible-type tobacco products; and smokeless tobacco products (for example, a snuff, and an oral tobacco).

The present invention can provide a black liquor according to a simpler method than a conventional method for preparing a black liquor (for example, an acid sulfite pulping process). That is, in the method of the present invention, a black liquor can be obtained by merely performing a one step reaction of subjecting a tobacco raw material to a digesting treatment under an alkaline condition. A method for preparing the black liquor according to the present invention also has a feature that it has a shorter heating time than that in the conventional method. The black liquor obtained by the method of the present invention contains the flavor component in an amount equal to or greater than, that of the black liquor obtained by the conventional method. In the present invention, a treatment using a chemical solution containing sulfur is not performed, unlike in the conventional method for preparing a black liquor, and thereby a cigarette having good smoking taste can be obtained when the black liquor obtained in the present invention is applied to a cigarette. Therefore, the present invention can provide a black liquor containing a flavor component in a shorter period of time with fewer treating processes.

EXAMPLES

Hereinafter, the present invention will be described in detail with reference to the Examples. However, the present invention are not limited thereto.

Preparation of Black Liquor

Example 1

One g of roughly crushed pieces of flue-cured tobacco stalk or burley tobacco stalk, and 50 mL of a 2N NaOH aqueous solution were sealed in a pressure-resistant container, heated to 180° C. while being stirred, and then held in this state for 3 hours. Then, the heated product was cooled together with the container. A black liquor and a residue (that is, a tobacco fiber) were filtered with a glass filter, and separated and recovered. An amount of a flavor component contained in the black liquor was measured by GCMS, and the measured value was regarded as an amount of a flavor component produced from 1 g of a tobacco raw material.

The amount of the flavor component contained in the black liquor was measured by the following method.

[Pretreatment of Black Liquor]

An internal standard substance (p-BPA: 50 μg) was added to the black liquor, and the total amount was adjusted to 40 ml with pure water. Then, a 1 N HCl aqueous solution was added to the resultant solution to adjust a pH to 2±0.1. The total amount of the pH-adjusted black liquor was made to pass through a solid phase extraction column Oasis HLB 1 g/20 cc (manufactured by Waters) which had been previously conditioned in diethylether (20 ml) methanol (20 ml)→0.01 N HCl aqueous solution (20 ml) in this order. Then, diethylether was made to pass through the solid phase extraction column to obtain a recovery liquid. The obtained recovery liquid was concentrated at normal pressure, and then diluted with diethylether to a given volume to obtain an analysis sample. GCMS analysis of the obtained analysis sample was performed by the following method.

[GCMS Analysis]

The GCMS analysis was performed by using an HP6890 GC system, a 5973N mass spectrometer, and a DB-FFAP column (30 m, 0.2 mm, 0.25 μm) (all manufactured by Agilent). Analysis conditions are shown in detail in the following Table A.

TABLE A

GC: HP6890, MS: 5973N *Agilent

| Parameter | Condition |
|---|---|
| Injection Port Temperature | 230° C. |
| Injection Volume | 3 μl |
| Injection Mode | Split (Split ratio 10:1)<br>Pressures: 1038 Psi<br>Split Vent: 12 ml/min<br>Gas Saver: 20 ml/min |
| Helium Flow | 1.2 ml/min (Constant Flow Mode) |
| Transfer Line temperature | 240° C. |
| MS Quadrupole temperature | 150° C. |
| MS Source temperature | 230° C. |
| Oven temperature | 60° C. for 2 min → 10° C./min to 120° C. (6 min) → 3° C./min to 180° C. (20 min) → 10° C./min to<br>240° C. (6 min) → Hold (15 min) |
| Column | DB-FFAP (30 m, 0.25 mm, 0.25 μm)<br>*Agilent |

The results are shown in the following Table 1. Compounds listed as flavor components in Table 1 are considered to affect the smoking flavor and taste of a cigarette.

TABLE 1

Amount of flavor components contained in black liquor obtained from 1 g of tobacco raw material (unit: μg)

| Flavor components | Flue-cured tobacco stalk | Burley tobacco stalk |
|---|---|---|
| 2-furfural | 0.75 | 0.75 |
| 2-acetylfuran | 1.25 | 1.25 |
| Furanmethanol | 8.00 | 8.50 |
| Cyclotene | 1110.00 | 902.38 |
| Maltol | 9.38 | 8.63 |
| 5-HMF | 2.00 | 1.50 |
| Benzaldehyde | 4.13 | 4.38 |
| Guaiacol | 546.13 | 587.63 |
| Benzyl alcohol | 14.13 | 12.88 |
| Phenethyl alcohol | 39.13 | 40.13 |
| Phenol | 30.13 | 16.38 |
| 2,6-dimethoxy phenol | 1019.38 | 1192.00 |
| Vanillin | 1535.38 | 2002.25 |

Example 2

One g of roughly crushed pieces of burley tobacco stalk, and 50 mL of a 2N NaOH aqueous solution were sealed in a pressure-resistant container, heated to a predetermined temperature while being stirred, and then held in this state for a given length of time. A heating temperature was set to 130° C., 150° C., and 180° C., and a holding time was changed within a range of 5 to 320 minutes. The subsequent cooling process and separation recovery process were performed in the same way as Example 1. An amount of vanillin contained in a black liquor was measured by GCMS, and the measured value was regarded as an amount of vanillin produced from 1 g of a tobacco raw material. A weight of a separated residue was measured, and the measured value was regarded as a residue amount obtained from 1 g of a tobacco raw material. The results are shown in FIGS. 2A and 2B.

Figure 2A:
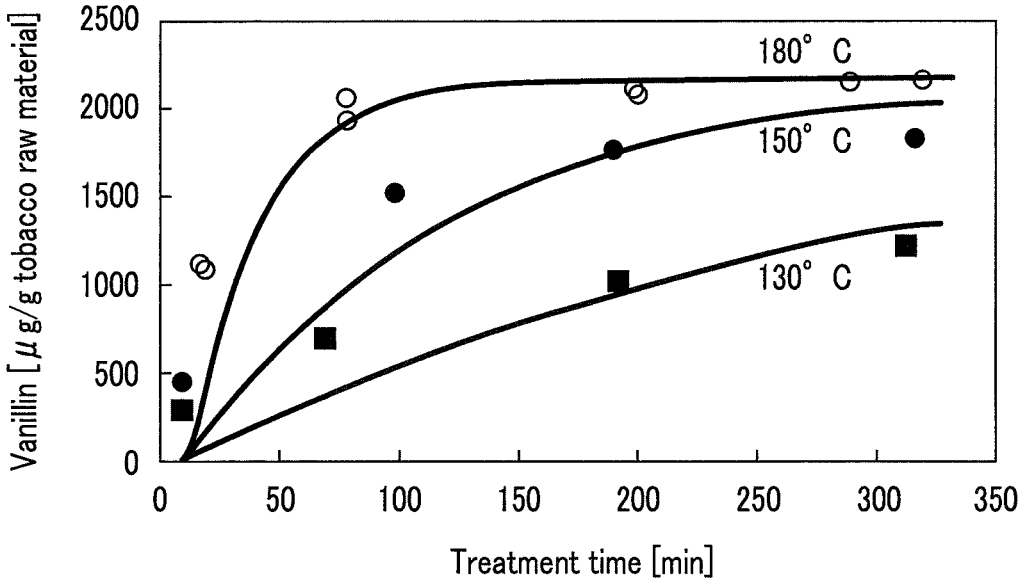
FIG. 2A shows the relationship of a vanillin production amount to a time and a temperature for a digesting treatment.
Figure 2B:
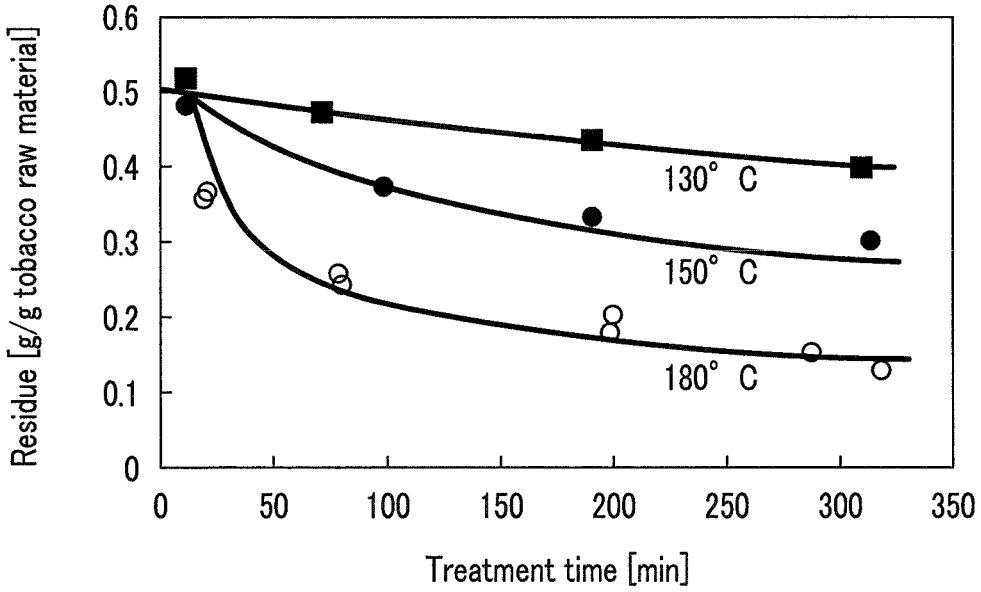
FIG. 2B shows the relationship of a residue amount to a time and a temperature for a digesting treatment.

FIG. 2A shows the relationship of a vanillin production amount to a time and a temperature for a digesting treatment. FIG. 2B shows the relationship of a residue amount to a time and a temperature for a digesting treatment. From FIG. 2A, it is found that the amount of vanillin contained in the black liquor tends to be increased the higher a digesting temperature is or the longer a treating time is, within the measured range. From FIG. 2B, it is found that the separated residue amount tends to be decreased the higher a digesting temperature is or the longer a treating time is, within the measured range.

Example 3

One g of roughly crushed pieces of burley tobacco stalk, and 50 mL or 10 mL of a 2N NaOH aqueous solution were sealed in a pressure-resistant container, heated to 180° C. while being stirred, and then held in this state for a predetermined time. A holding time was changed within a range of 5 to 320 minutes. The subsequent cooling process and separation recovery process were performed in the same way as Example 1. An amount of vanillin contained in a black liquor and a weight of a separated residue were measured in the same way as Example 2. The results are shown in FIGS. 3A and 3B.

Figure 3A:
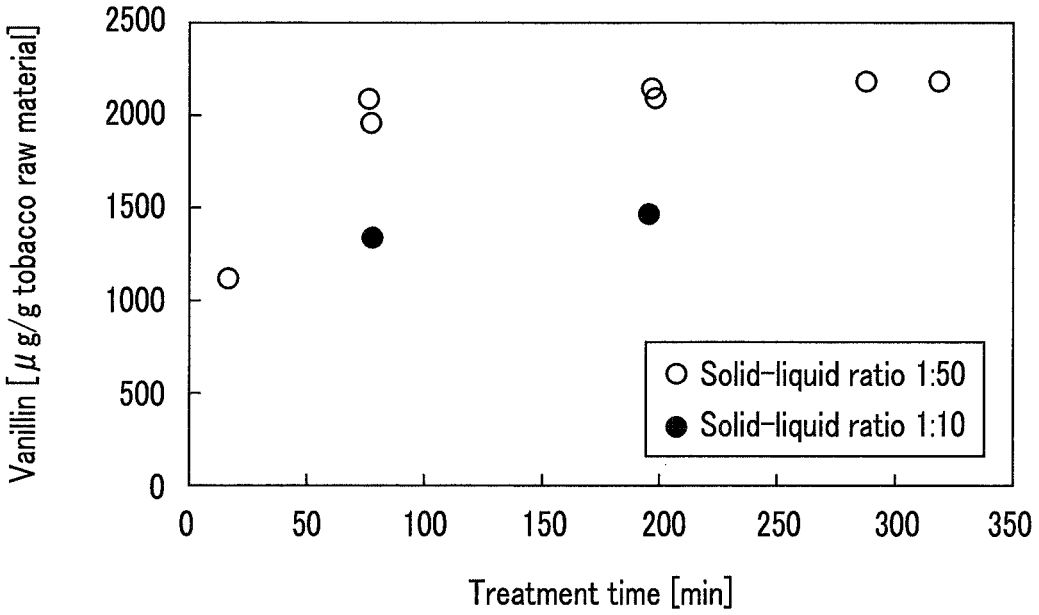
FIG. 3A shows the relationship of a vanillin production amount to a time and a solid-liquid ratio for a digesting treatment.
Figure 3B:
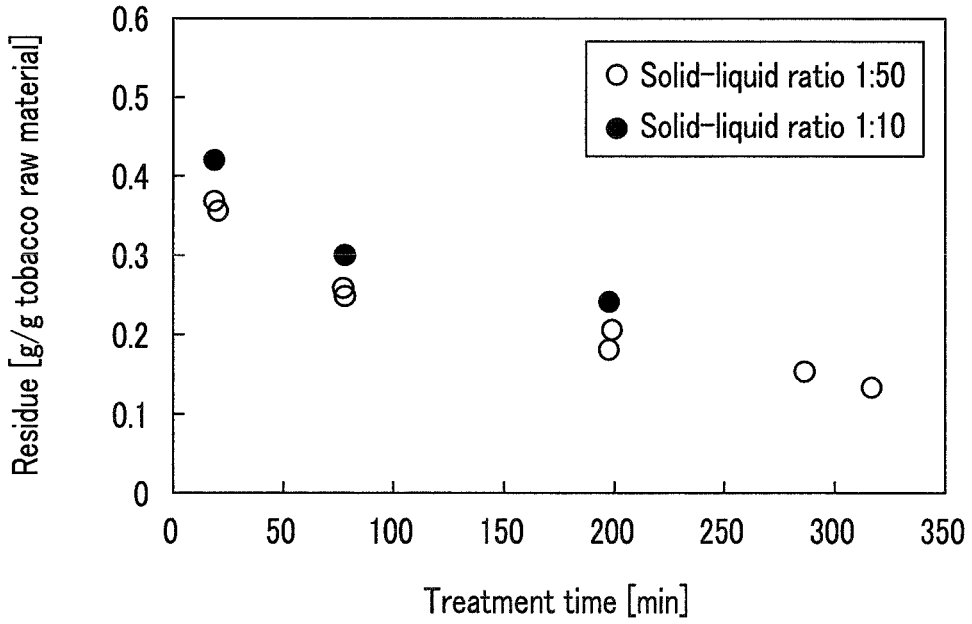
FIG. 3B shows the relationship of a residue amount to a time and a solid-liquid ratio for a digesting treatment.

FIG. 3A shows the relationship of a vanillin production amount to a time and a solid-liquid ratio for a digesting treatment. FIG. 3B shows the relationship of a residue amount to a time and a solid-liquid ratio for a digesting treatment. Herein, when 50 mL of 2N NaOH aqueous solution was used per 1 g of the tobacco raw material, the solid-liquid ratio was expressed as 1:50, and when 10 mL of 2N NaOH aqueous solution was used per 1 g of the tobacco raw material, the solid-liquid ratio was expressed as 1:10.

From FIG. 3A, it is found that the amount of vanillin contained in the black liquor tends to be increased with an increased amount of the alkaline aqueous solution to be used. From FIG. 3B, it is found that the separated residue amount tends to be decreased with an increased amount of the alkaline solution to be used, although the difference is not remarkable.

Example 4

One g of roughly crushed pieces of burley tobacco stalk, and 50 mL of an alkaline aqueous solution were sealed in a pressure-resistant container, heated to 180° C. while being stirred, and then held in this state for a predetermined time. A holding time was changed within a range of 5 to 320 minutes. A 2N NaOH (pH 14.3) aqueous solution, a 0.5N NaOH aqueous solution (pH 13.6), a 0.1N NaOH aqueous solution (pH 12.9), a 0.05N NaOH aqueous solution (pH 12.6), a 0.01N NaOH aqueous solution (pH 12.0), a 2N KOH aqueous solution (pH 14.3), a 0.1N KOH aqueous solution (pH 12.9), or 4 mol/kg of a $K_2CO_3$ aqueous solution (pH 12.5) was used as the alkaline aqueous solution. The subsequent cooling process and separation recovery process were performed in the same way as Example 1. Amounts of vanillin and syringaldehyde contained in a black liquor were measured by GCMS, and the measured values were regarded as amounts of vanillin and syringaldehyde produced from 1 g of a tobacco raw material. A weight of a separated residue was measured, and the measured value was regarded as a residue amount obtained from 1 g of a tobacco raw material. The results are shown in FIGS. 4A, 4B, and 4C.

Figure 4A:
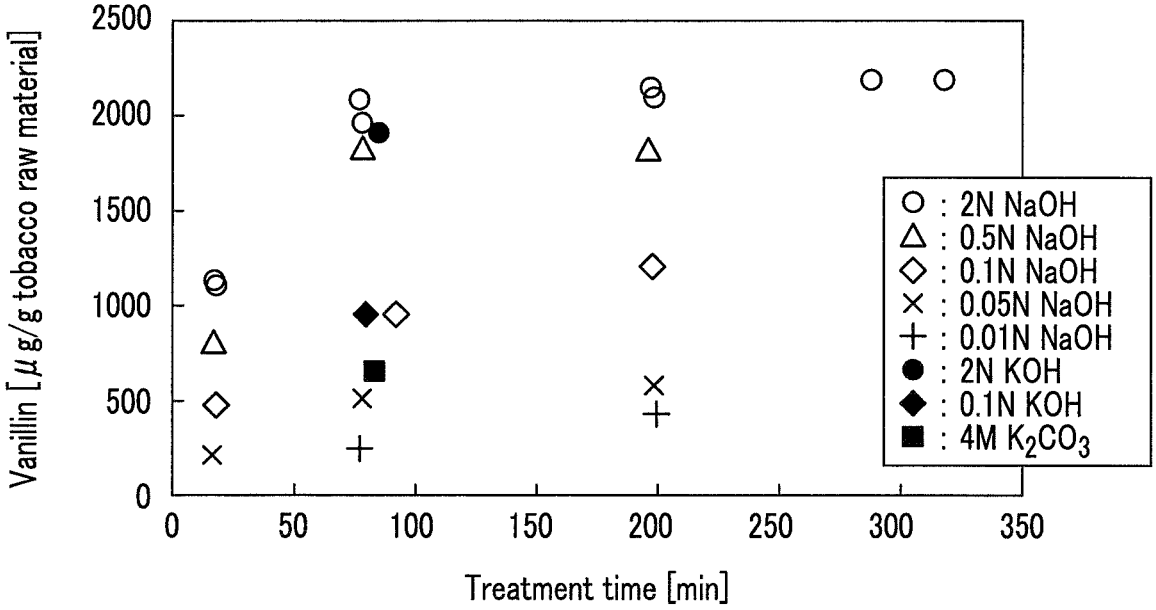
FIG. 4A shows the relationship of a vanillin production amount to a time for a digesting treatment, and a kind and a concentration of a chemical solution to be used.

FIG. 4A shows the relationship of a vanillin production amount to a time for a digesting treatment, and a kind and a concentration of a chemical solution to be used. FIG. 4B shows the relationship of a syringaldehyde production amount to a time for a digesting treatment, and a kind and a concentration of a chemical solution to be used. FIG. 4C shows the relationship of a residue amount to a time for a digesting treatment, and a kind and a concentration of a chemical solution to be used.

Figure 4B:
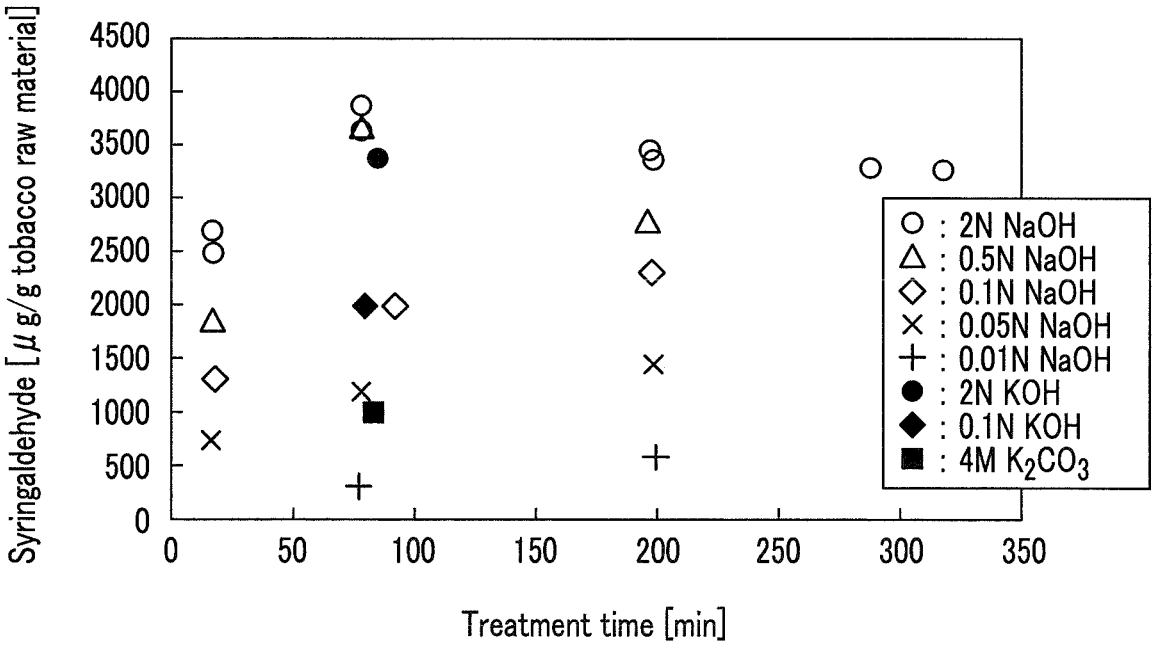
FIG. 4B shows the relationship of a syringaldehyde production amount to a time for a digesting treatment, and a kind and a concentration of a chemical solution to be used.
Figure 4C:
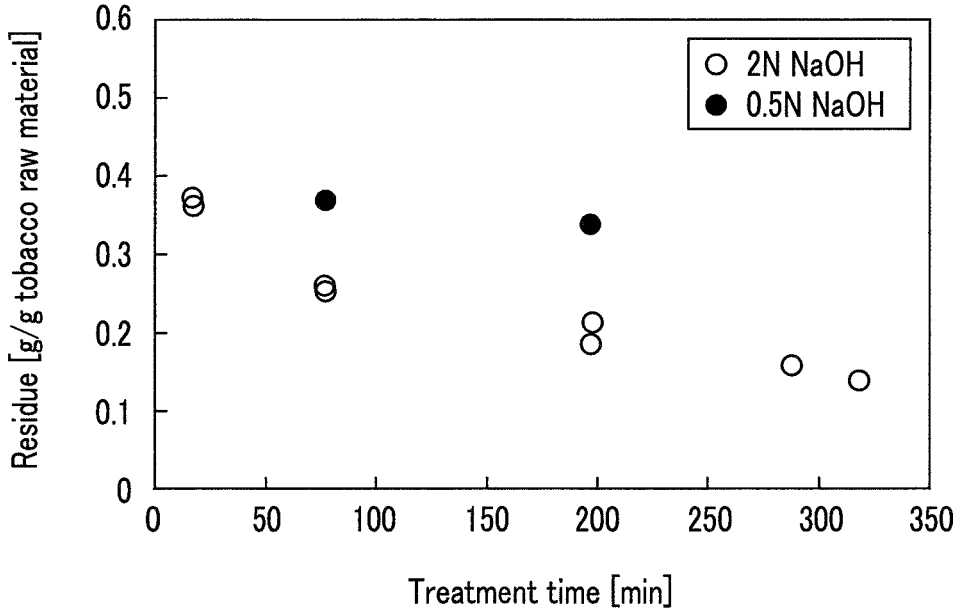
FIG. 4C shows the relationship of a residue amount to a time for a digesting treatment, and a kind and a concentration of a chemical solution to be used.

From FIGS. 4A and 4B, the chemical solution for the digesting treatment is found to be used in a concentration of, preferably 0.1 N or more, and more preferably 0.5 N or more from the viewpoint of obtaining the black liquor containing a larger amount of flavor component. The digesting treatment is also found to be preferably performed under a condition of a pH 12.9 to 14.3. From the above, it can be said that the digesting treatment is preferably performed under a strong alkaline condition. From FIG. 4C, it is found that when the alkalinity of the chemical solution to be used is stronger, the separated residue amount tends to be decreased.

Example 5

Comparison of Amount of Volatile Component Obtained by Digesting Treatment

Regarding samples A to D of black liquors shown below, a vanillin production amount was measured by GCMS. The results are shown in FIG. 5. In FIG. 5, the vanillin production amount is shown as an amount produced from 1 g of a tobacco raw material.

Sample A

Example 1

The case where 1 g of roughly crushed pieces of burley tobacco stalk were used as a tobacco raw material in Example 1, was used as a sample A.

Sample B

Oxygen Filling

Roughly crushed pieces of burley tobacco stalk and a 2N NaOH aqueous solution were sealed at a solid-liquid ratio of 1:50 (50 mL of NaOH per 1 g of a tobacco raw material) (hereinafter, the same shall apply) in a pressure-resistant container, and then the container was filled with oxygen so that the gage pressure was set to 0.1 MPa. This was heated to 180° C. while being stirred, and then held in this state for 3 hours. The subsequent cooling process and separation recovery process were performed in the same way as Example 1.

Sample C

Neutral Sulfite Pulping Process

Seven hundred g of roughly crushed pieces of burley tobacco stalk, 210 g of $Na_2SO_3$, 26.6 g of NaOH, 0.35 g of anthraquinone, and 2.1 L of water were sealed in a pressure-resistant container (solid-liquid ratio 1:3). This was heated to 179° C. while being stirred, and then held in this state for 6 hours. The subsequent cooling process and separation recovery process were performed in the same way as Example 1.

Sample D

Acid Sulfite Pulping Process

Five hundred g of roughly crushed pieces of burley tobacco stalk, and 2 L of a digesting chemical solution (9% by weight of $SO_2$, 1.32% by weight of $Ca(OH)_2$) were sealed in a pressure-resistant container (solid-liquid ratio 1:4). This was heated to 158° C., and then held in this state for 6 hours. Then, the heated product was cooled together with the container. A black liquor and a residue (that is, a tobacco fiber) were filtered with a glass filter, and separated and recovered. NaOH was added to the obtained black liquor so that the concentration of NaOH was set to 2 N. This was sealed in a pressure-resistant container, and heated at 180° C. for 3 hours. After cooling, the black liquor was recovered.

From FIG. 5, according to the method of the present invention (samples A and B), the black liquor containing vanillin is found to be obtained as in the case where the digesting treatment is performed by the neutral sulfite pulping process and the acid sulfite pulping process (samples C and D). In particular, in the case where the container was filled with oxygen (sample B), the black liquor containing a very large amount of vanillin was obtained in a short time.

Example 6

Comparison of Amount of Volatile Component Obtained by Digesting Treatment Under Oxygen Filling Condition To 700 g of roughly crushed pieces of burley tobacco stalk, 2.1 L, 3.5 L, and 7 L of 2N NaOH aqueous solutions were added, to prepare samples so that solid-liquid ratios were set to 1:3, 1:5, and 1:10, respectively. These were sealed in a pressure-resistant container. Furthermore, air in the pressure-resistant container was replaced with oxygen at 0.4 MPa (gage pressure). The pressure-resistant container was heated to 150° C. while being stirred, and then held in this state for 3 hours. Then, the heated product was cooled together with the pressure-resistant container. A black liquor and a residue (that is, a tobacco fiber) were filtered with a glass filter, and separated and recovered. An amount of vanillin contained in the black liquor was measured by GCMS, and the measured value was regarded as a vanillin production amount from 1 g of a tobacco raw material. The results are shown in FIG. 6. From FIG. 6, it is found that the vanillin production amount is particularly increased when the solid-liquid ratio is 1:5 or more.

Example 7

Figure 7:
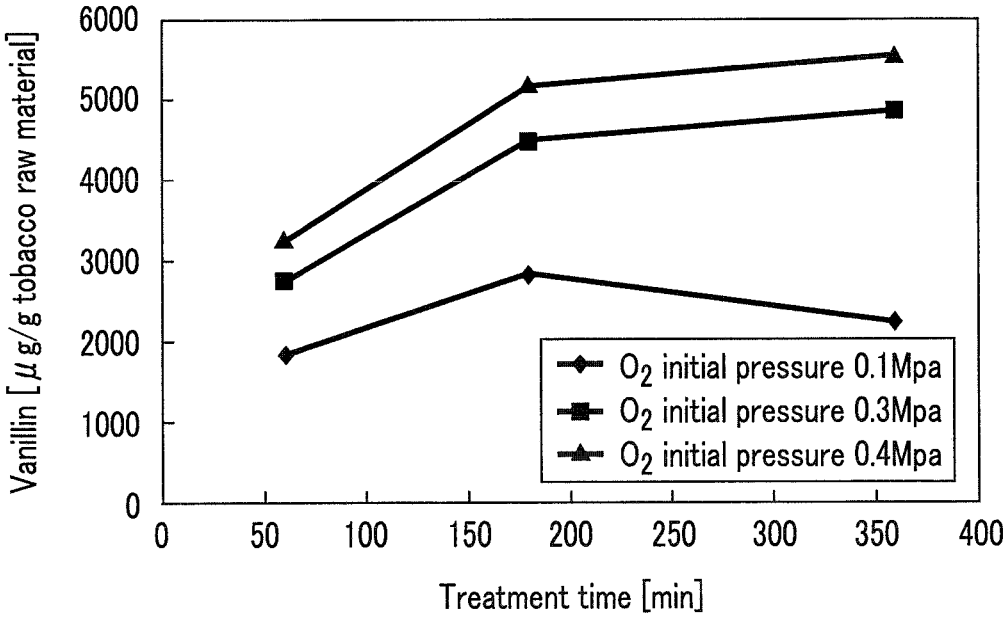
FIG. 7 shows the relationship of a vanillin production amount to an oxygen filling pressure in a digesting treatment in an oxygen atmosphere.

Comparison of Amount of Volatile Component Obtained by Digesting Treatment Under Oxygen Filling Condition Seven hundred g of roughly crushed pieces of burley tobacco stalk and 7 L of a 2N NaOH aqueous solution were sealed in a pressure-resistant container. Furthermore, air in the pressure-resistant container was replaced with oxygen at 0.1 MPa, 0.3 MPa, and 0.4 MPa (gage pressure). The pressure-resistant container was heated to 150° C. while being stirred, and then held in this state for 1 hour, 3 hours, and 6 hours. Then, the heated product was cooled together with the pressure-resistant container. A black liquor and a residue (that is, a tobacco fiber) were filtered with a glass filter, and separated and recovered. An amount of vanillin contained in the black liquor was measured by GCMS, and a vanillin production amount from 1 g of a tobacco raw material was calculated from the measured value. The results are shown in FIG. 7. From FIG. 7, it is found that the vanillin production amount is increased when the pressure of the replaced oxygen is increased.

Example 8

Figure 8:
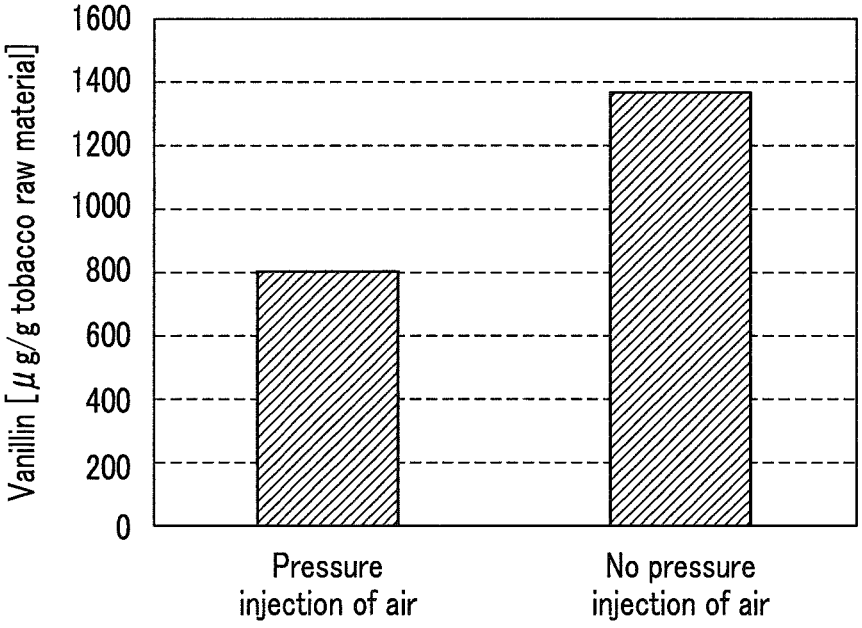
FIG. 8 shows a vanillin production amount in a digesting treatment under a condition where air is injected under pressure.

Comparison of Amount of Volatile Component Obtained by Digesting Treatment Under Condition where Air is Injected Under Pressure Five g of roughly crushed pieces of burley tobacco stalk and 50 mL of a 2N NaOH aqueous solution were sealed in a pressure-resistant container. Furthermore, air was injected under pressure into the pressure-resistant container so that the pressure was set to 0.5 MPa (gage pressure). The pressure-resistant container was heated to 150° C. while being stirred, and then held in this state for 3 hours. Then, the heated product was cooled together with the pressure-resistant container. A black liquor and a residue (that is, a tobacco fiber) were filtered with a glass filter, and separated and recovered. As a comparison, a treatment was conducted in the same way as the above conditions except that air was not injected under pressure. An amount of vanillin contained in each black liquor was measured by GCMS, and a vanillin production amount from 1 g of a tobacco raw material was calculated from the measured value. The results are shown in FIG. 8. From FIG. 8, it is found that in the case where air is injected under pressure to carry out the reaction under a high oxygen atmosphere condition, the vanillin production amount is more than that in the case where air is not injected under pressure.

Preparation of Flavor Component-Containing Liquid

Example 9

Desalination of Black Liquor by Solvent Extraction

Hydrochloric acid was added to the black liquor obtained in Example 1, to neutralize the black liquor so that the pH was set to 7 or less. The neutralized black liquor and ethyl acetate of an amount equal to that of the black liquor were charged into a separating funnel, and sufficiently stirred. The resultant solution was left for a while, and then an organic layer was recovered. The organic layer was concentrated by using a rotary evaporator to remove ethyl acetate. An appropriate amount of ethanol was added to the obtained dried product to obtain a flavor component-containing liquid having a sweet flavor. A concentration of vanillin contained in the obtained flavor component-containing liquid was measured by GCMS, and a vanillin recovery rate from the original black liquor was calculated from the measured value. The results are shown in Table 3.

Example 10

Desalination of Black Liquor by Synthetic Adsorbent

Hydrochloric acid was added to the black liquor obtained under a condition of a solid-liquid ratio 1:10 in Example 6, to neutralize the black liquor so that the pH was set to 7 or less. Four hundred and forty mL of the neutralized black liquor was made to pass through a column filled with 30 mL of a styrene-based synthetic adsorbent (Amberlite XAD4, Organo Corporation), and then pure water was made to pass through the column to wash the synthetic adsorbent. Furthermore, 240 mL of ethanol was made to pass through the column to recover the total amount. A concentration of vanillin contained in the recovered ethanol solution was measured by GCMS, and a vanillin recovery rate from the original black liquor was calculated from the measured value. The results are shown in Table 3.

Example 11

Desalination of Black Liquor by Ion Exchange

The black liquor obtained in Example 1 was diluted 10 times with water, and the resultant solution was made to pass through a column filled with a cation-exchange resin (Amberlite IRC76, Organo Corporation). When the liquid passing through the column was recovered, and a pH of the recovered fraction was measured, the fraction had a pH of 2 to 6. From the pH value, it was found that $Na^+$ ions contained in the black liquor were exchanged with $H^+$ ions in the fraction. Further, when a concentration of vanillin contained in the fraction was measured by GCMS, the concentration was about the same as that of the black liquor which has not yet been made to pass through the column. A vanillin recovery rate from the original black liquor was calculated. The results are shown in Table 3.

Example 12

Desalination of Black Liquor by Vacuum Concentration and Change in Amount of Vanillin in Black Liquor A black liquor was desalted by vacuum concentration, and a change in an amount of vanillin in a black liquor were investigated as follows by using a model aqueous solution.

Twenty g of the model aqueous solution (2 mol/L NaCl, vanillin 0.221 g) was concentrated under reduced pressure at 50° C. by using an evaporator, to dry the model aqueous solution. The obtained dried product was dissolved in ethanol, and the resultant solution was filtered by using filter paper. A vanillin concentration of the obtained recovery liquid was measured by GCMS. A vanillin recovery rate was calculated by comparing the amount of vanillin contained in the recovery liquid after vacuum concentration with the amount of vanillin contained in the model aqueous solution before vacuum concentration. The results are shown in Tables 2 and 3.

The results of the above tests (Examples 8 to 12) are shown in the following Tables 2 and 3.

TABLE 2

| Vanillin recovery rate | | |
|---|---|---|
| | Vanillin content [g/20 g solution] | Vanillin recovery rate |
| Model aqueous solution | 0.221 | 100% |
| Recovery liquid | 0.189 | 85.5% |

TABLE 3

| Vanillin recovery rate | | |
|---|---|---|
| | Desalination method | Vanillin recovery rate |
| Example 9 | Desalination of black liquor by solvent extraction (ethyl acetate) | 62.5% |
| Example 10 | Desalination of black liquor by synthetic adsorbent | 91.8% |
| Example 11 | Desalination of black liquor by ion-exchange resin | 90.5% |
| Example 12 | Desalination of black liquor by vacuum concentration | 85.5% |

From Tables 2 and 3, it is found that the desalination of the black liquor by the synthetic adsorbent provides the highest vanillin recovery rate, and is very suitable as the desalinating method in the present invention. From Tables 2 and 3, it is found that desalinating methods other than the desalination by the synthetic adsorbent also provide a good vanillin recovery rate. Therefore, it can be said that the loss amount of vanillin caused by the desalination process is slight, and the desalinating process does not affect the effect of the present invention (that is, the preparation of the flavor component-containing liquid containing flavor components).

Preparation of Tobacco Filler

Example 13

The flavor component-containing liquid obtained in Example 9 was spray-coated on a base sheet tobacco produced by using a tobacco fiber obtained from burley tobacco stalk, and dried. The dried sheet tobacco was cut to obtain a tobacco filler.

Preparation of Cigarette

Example 14

10% by weight of the tobacco filler obtained in Example 13 was blended with a shredded tobacco (90% by weight) to produce a hand-rolled cigarette. When the produced cigarette was smoked, a vanilla-like flavor and taste were felt.

The invention claimed is:

1. A method for preparing a tobacco filler, the method comprising:

digesting a tobacco raw material under an alkaline condition in a container into which oxygen or air has been injected under pressure;

separating the obtained digesting product into a black liquor and a tobacco fiber; and desalinating the black liquor to obtain a flavor component-containing liquid; and applying the flavor component-containing liquid to a tobacco fiber or a formed product of the tobacco fiber.

2. The method for preparing a tobacco filler according to claim 1, wherein the tobacco fiber or the formed product of the tobacco fiber is a base sheet tobacco.

3. A tobacco filler obtained by the method according to claim 1.

4. A cigarette comprising the tobacco filler according to claim 3.

5. A tobacco product comprising the tobacco filler according to claim 3.

6. A noncombustible-type tobacco product comprising the tobacco filler according to claim 3.

7. A smokeless tobacco comprising the tobacco filler according to claim 3.

8. The method for preparing a tobacco filler according to claim 1, further comprising neutralizing the digesting product or the black liquor after the digesting or the separating.

9. The method for preparing a tobacco filler according to claim 1, wherein the digesting is performed by using an alkaline solution of 0.01 N or more.

10. The method for preparing a tobacco filler according to claim 1, wherein the digesting is performed by using an alkaline solution having a pH of 12 or more.

* * * * *